US007075483B2

(12) United States Patent
Okado

(10) Patent No.: US 7,075,483 B2
(45) Date of Patent: Jul. 11, 2006

(54) WIDE BANDWIDTH ANTENNA

(75) Inventor: Hironori Okado, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 10/657,108

(22) Filed: Sep. 9, 2003

(65) Prior Publication Data

US 2004/0100408 A1 May 27, 2004

(30) Foreign Application Priority Data

Nov. 27, 2002 (JP) ..... 2002-343290
Mar. 4, 2003 (JP) ..... 2003-056740
Jun. 5, 2003 (JP) ..... 2003-160176

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/769, 752, 793, 829, 830, 848, 872, 795, 343/846

See application file for complete search history.

(56) References Cited

U.S. PATENT DOCUMENTS 4,083,046 A * 4/1978 Kaloi ..... 343/700 MS
4,151,531 A * 4/1979 Kaloi ..... 343/700 MS
4,151,532 A * 4/1979 Kaloi ..... 343/700 MS
4,500,887 A * 2/1985 Nester ..... 343/700 MS
4,605,012 A * 8/1986 Ringeisen et al. ..... 607/155
4,605,933 A * 8/1986 Butscher ..... 343/700 MS
5,255,002 A 10/1993 Day
5,521,606 A 5/1996 Iijima et al.
5,532,707 A * 7/1996 Klinger et al. ..... 343/793
5,847,682 A * 12/1998 Ke ..... 343/752
5,872,546 A 2/1999 Ihara et al. ..... 343/795
6,046,703 A 4/2000 Wang et al.
6,097,345 A * 8/2000 Walton ..... 343/769
6,133,879 A 10/2000 Grangeat et al.
6,157,344 A * 12/2000 Bateman et al. ..... 343/700 MS
6,232,925 B1 5/2001 Hiroshi (Continued)

FOREIGN PATENT DOCUMENTS

EP 0 831 548 A2 3/1998

(Continued)

OTHER PUBLICATIONS

John D. Kraus, "Antennas", 2nd edition 1988 McGraw-Hill, pp. 346-347 and pp. 723-725.

(Continued)

*Primary Examiner*—Tan Ho
*Assistant Examiner*—Hung Tran Vy
(74) *Attorney, Agent, or Firm*—Oliff & Berridge, PLC

(57) ABSTRACT

An antenna according to this invention comprises a ground pattern; and a planar element that has a feed point and whose edge portion opposite to the ground pattern has a trimmed portion that makes a distance with the ground pattern vary and is composed of at least either one of a curved line and line segments which are connected while their inclinations are changed stepwise, and the ground pattern is juxtaposed with the planar element without fully surrounding the edge portion of the planar element. Since it is possible to appropriately adjust the coupling degree between the ground pattern and the planar element by juxtaposing the ground pattern with the planar element and providing the aforementioned trimmed portion, the wide bandwidth is achieved. In addition, by disposing the ground pattern and the planar element in the aforementioned positional relationship, the entire antenna can also be miniaturized.

7 Claims, 12 Drawing Sheets

U.S. PATENT DOCUMENTS

| | | | | |
|---|---|---|---|---|
| 6,249,254 | B1 * | 6/2001 | Bateman et al. | 343/700 MS |
| 6,259,416 | B1 * | 7/2001 | Qi et al. | 343/767 |
| 6,329,950 | B1 | 12/2001 | Harrell et al. | |
| 6,351,246 | B1 | 2/2002 | McCorkle | |
| 6,452,548 | B1 | 9/2002 | Shoji et al. | |
| 6,515,626 | B1 | 2/2003 | Bark et al. | |
| 6,590,545 | B1 * | 7/2003 | McCorkle | 343/830 |
| 6,603,429 | B1 * | 8/2003 | Bancroft et al. | 343/700 MS |
| 6,707,427 | B1 * | 3/2004 | Konishi et al. | 343/700 MS |
| 6,720,924 | B1 | 4/2004 | Isao et al. | |
| 6,747,600 | B1 | 6/2004 | Wong et al. | |
| 6,747,605 | B1 | 6/2004 | Lebaric et al. | |
| 6,762,723 | B1 | 7/2004 | Nallo et al. | |
| 6,768,461 | B1 * | 7/2004 | Huebner et al. | 343/700 MS |
| 2002/0015000 | A1 | 2/2002 | Reece et al. | |
| 2002/0026586 | A1 | 2/2002 | Takafumi | |
| 2002/0122010 | A1 | 9/2002 | McCorkle | |
| 2003/0020668 | A1 | 1/2003 | Peterson | |
| 2003/0034920 | A1 | 2/2003 | Lee | |
| 2003/0156064 | A1 | 8/2003 | Bancroft et al. | |

FOREIGN PATENT DOCUMENTS

| | | |
|---|---|---|
| EP | 1 198 027 A1 | 4/2002 |
| JP | S31-000709 Y | 1/1956 |
| JP | A 55-4109 | 1/1980 |
| JP | A 57-142003 | 9/1982 |
| JP | A 63-275204 | 11/1988 |
| JP | A 05-063425 | 3/1993 |
| JP | U 5-76109 | 10/1993 |
| JP | A-5-82122 | 11/1993 |
| JP | A 06-291530 | 10/1994 |
| JP | U 3008389 | 12/1994 |
| JP | A 8-213820 | 8/1996 |
| JP | A 09-223921 | 8/1997 |
| JP | A 11-27026 | 1/1999 |
| JP | A 2000-183789 | 6/2000 |
| JP | A 2001-156532 | 6/2001 |
| JP | A 2001-203529 | 7/2001 |
| JP | A 2001-217632 | 8/2001 |
| JP | A 2001-217643 | 8/2001 |
| JP | A 2002-077999 | 3/2002 |
| JP | A 2002-100915 | 4/2002 |
| JP | A 2002-171126 | 6/2002 |
| JP | A 2002-252515 | 9/2002 |
| JP | A 2002-319811 | 10/2002 |

OTHER PUBLICATIONS

"Antenna Engineering Handbook", Electronic Information Communication Institution, p. 128, no months-years.

Honda et al., "Improved Input Impedance of Circular Disc Monopole Antenna," Spring National Convention of The Institute of Electronics, Information and Communication Engineers, pp. 2-131, B-131, Mar. 27, 1992.

Ihara et al., "Broadband Characteristics of Semi-Circuler Antenna combined with Linear Element," General Convention of The Institute of Electronics, Information and Communication Engineers, pp. 77, B-77, Mar. 31, 1996.

Ihara et al., "A Small Broadband Antenna with Rounded Semi-Circular Element," Society Conference of The Institute of Electronics, Information and Communication Engineers, pp. 78, B-78, Sep. 21, 1996.

Honda et al., "Wideband Monopole Antenna of Circular Disc," Technical Reports of The Institute of Television, vol. 15, No. 59, pp. 25-30, Oct. 24, 1991.

* cited by examiner

WIDE BANDWIDTH ANTENNA

TECHNICAL FIELD OF THE INVENTION

The present invention relates to a wide bandwidth antenna.

BACKGROUND OF THE INVENTION

For example, JP-A-57-142003 discloses the following antennas. That is, it discloses a monopole antenna in which a flat-plate type radiation element 1001 having a disc shape is erected vertically to an earth plate or the ground 1002 as shown in FIGS. 16A-1 and 16A-2. This monopole antenna is designed so that a high-frequency power source 1004 and the radiation element 1001 are connected to each other through a power feeder 1003 and the height of the top portion of the radiation element 1001 is set to a quarter wavelength. Furthermore, it also discloses a monopole antenna in which a flat-plate type radiation element 1005 whose upper peripheral edge portion has a shape extending along a predetermined parabola is erected vertically to an earth plate or the ground 1002. Still furthermore, it discloses a dipole antenna in which two radiation elements 1001 of the monopole antenna shown in FIGS. 16A-1 and 16A-2 are symmetrically arranged as shown in FIG. 16C. Still furthermore, it discloses a dipole antenna in which two radiation elements 1005 of the monopole antenna shown in FIGS. 16B-1 and 16B-2 are symmetrically arranged as shown in FIG. 16D.

In addition, JP-A-55-4109 discloses the following antennas, for example. That is, a sheet-type elliptical antenna 1006 is erected vertically to a refection surface 1007 so that the major axis thereof is parallel to the reflection surface 1007, and power supply is carried out through a coaxial power feeder 1008, as shown in FIG. 16E. FIG. 16F shows an example in which the antenna is configured as a dipole. In the case of the dipole type, the sheet-type elliptical antennas 1006*a* are arranged on the same plane so that the minor axes thereof are located on the same line, and a slight gap is disposed so that a balanced feeder 1009 is connected to both the antennas.

Besides, a monopole antenna as shown in FIG. 16G is disclosed in "B-77: BROADBAND CHARACTERISTICS OF SEMI-CIRCULAR ANTENNA COMBINED WITH LINEAR ELEMENT", Taisuke Ihara, Makoto Kijima and Koichi Tsunekawa, pp 77 General Convention of The Institute of Electronics, Information and Communication Engineers, 1996 (hereinafter referred to as "non-patent document 1"). As shown in FIG. 16G, a semicircular element 1010 is erected vertically to an earth plate 1011, and the nearest point of the arc of the element 1010 to the earth plate 1011 serves as a feed portion 1012. The non-patent document 1 shows that the frequency $f_L$ at which the radius of the circle almost corresponds to a quarter wavelength is the lower limit. Furthermore, it also describes an example where an element 1013 achieved by forming a cut-out portion in the element 1010 shown in FIG. 16G is erected vertically to the earth plate 1011 as shown in FIG. 16H, and that little difference exists in VSWR (Voltage Standing Wave Ratio) characteristic between the monopole antenna shown in FIG. 16G and the monopole antenna shown in FIG. 16H. Furthermore, it also discloses an example where an element 1014, which is formed by connecting an element 1014*a*, which resonates at $f_L$ or less and has a meander monopole structure, to an element with the cut-out portion as shown in FIG. 16H, is erected vertically to the earth plate 1011 as shown in FIG. 16I. Incidentally, the element 1014*a* is disposed to be accommodated in the cut-out portion. The antenna resonates at a frequency lower than $f_L$ because of the element 1014*a*, however, the VSWR characteristic is bad. In connection with the non-patent document 1, disc type monopole antennas are described in "B-131 IMPROVED INPUT IMPEDANCE OF CIRCULAR DISC MONOPOLE ANTENNA", Satoshi Honda, Yuken Ito, Hajime Seki and Yoshio Jinbo, 2-131, SPRING NATIONAL CONVENTION of The Institute of Electronics, Information and Communication Engineers, 1992, and "WIDEBAND MONOPOLE ANTENNA OF CIRCULAR DISC", Satoshi Honda, Yuken Ito, Yoshio Jinbo and Hajime Seiki, Vol. 15, No. 59, pp. 25–30, 1991.10.24 in "TECHNICAL REPORTS OF THE INSTITUTE OF TELEVISION".

The aforementioned antennas pertain to a monopole antenna in which a flat-plate conductor having various shapes is erected vertically to the ground surface, and a symmetric dipole antenna using two flat-plate conductors having the same shape.

Besides, U.S. Pat. No. 6,351,246 discloses a symmetric dipole antenna having a special shape as shown in FIG. 17. That is, a ground element 1103 is provided between conductive balance elements 1101 and 1102, and terminals 1104 and 1105, which are lowest portions of the balance element 1101 and 1102, are connected to the coaxial cables 1106 and 1107. Negative step voltage is supplied to the balance element 1101 via the coaxial cable 1106 and terminal 1104. On the other hand, positive step voltage is supplied to the balance element 1102 via the coaxial cable 1107 and terminal 1105. In this antenna 1100, though the distance between the ground element 1103 and the balance element 1101 or 1102 is gradually increased from the terminal 1104 or 1105 toward the outside, it is necessary to input different signals as described above to the balance elements 1101 and 1102, and in order to obtain desired characteristics, it is necessary to always use three elements, that is, the balance element 1101 and 1102 and the ground element 1103.

In addition, FIG. 18 shows a glass antenna device for an automobile telephone disclosed in JP-A-8-213820. In FIG. 18, a fan-shaped radiation pattern 1033 and a rectangular ground pattern 1034 are formed on a window glass 1032, a feed point A is connected to the core wire 1035*a* of a coaxial cable 1035, and a ground point B is connected to the outer conductor 1035*b* of the coaxial cable 1035. In this publication, the shape of the radiation pattern 1033 may be an isosceles triangular shape or a polygonal shape.

Furthermore, US-A-2002-122010A1 discloses an antenna 1020 in which a tapered clearance area 1023 and a driven element 1022 whose feed point 1025 is connected to a transmission line 1024 are provided within a ground element 1021 as shown in FIG. 19. Incidentally, the gap between the ground element 1021 and the driven element 1022 is maximum at the opposite side to the feed point 1025 on the driven element 1022, and the gap therebetween is minimum in the neighborhood of the feed point 1025. The driven element 1022 is equipped with a concavity at the opposite side to the feed point 1025 of the driven element 1022. The concavity itself is opposite to the ground element 1021, and it serves as means for adjusting the gap between the driven element 1022 and the ground element 1021. Incidentally, this publication also discloses a shape that does not have the concavity.

As described above, though various antennas have been hitherto known, the conventional vertical mount type monopole antennas have problems that their sizes are large, and it is difficult to control the antenna characteristic since it is difficult to control the distance between the radiation conductor and the ground surface. Furthermore, the conventional symmetrical type dipole antennas also have a problem that it is difficult to control the antenna characteristic since the radiation conductors have the same shape, thereby it is difficult to control the distance between the radiation conductors.

Besides, the special symmetric dipole antenna described in U.S. Pat. No. 6,351,246 has a problem on the implementation, in which a lot of elements and two kinds of signals, which are supplied to the elements, must be prepared. In addition, the distance between the ground pattern 1103 and the balance elements 1101 and 1102 straightly varies.

In addition, in the glass antenna device for the automobile telephone in JP-A-8-213820, the distance between the radiation pattern and the ground pattern straightly changes. This publication does not disclose that this distance is adjusted by a shape of the ground pattern. Moreover, such the glass antenna device for the automobile telephone cannot sufficiently achieve the wide bandwidth. Furthermore, there is no disclosure as to processing an external form of the ground pattern.

In addition, though the antenna of US-A-2002-122010A1 aims at miniaturization, the structure that the driven element is provided within the ground element cannot achieve the sufficient miniaturization because of the shape of the ground element. Besides, the shape of the ground element does not have a tapered shape with respect to the driven element.

SUMMARY OF THE INVENTION

In view of the foregoing problems, an object of the present invention is to provide an antenna having a novel shape that can be miniaturized and widened in bandwidth.

Furthermore, another object of the present invention is to provide an antenna having a novel shape that can be miniaturized and make it easy to control the antenna characteristic.

An antenna according to a first aspect of the invention comprises a ground pattern; and a planar element, which has a feed point and is juxtaposed with the ground pattern, and the planar element has a trimmed portion (may also be called as a continuous varying portion, for example) causing to continuously change a distance between the planar element and the ground pattern.

Since it becomes possible to appropriately adjust the coupling degree between the ground pattern and the planar element by juxtaposing the ground pattern with the planar element and providing the aforementioned trimmed portion, the wide bandwidth is achieved. In addition, the aforementioned trimmed portion may be formed from the feed point toward a side opposite to the ground pattern. Moreover, the planar element and the ground pattern may be formed extending along counter directions respectively.

Furthermore, the ground pattern may be disposed without surrounding the planar element. By disposing the ground pattern and the planar element in the aforementioned positional relationship, the entire antenna can also be miniaturized.

Incidentally, at the aforementioned trimmed portion, the distance with the ground pattern may be gradually increased as being farther away from the feed point of the planar element. Besides, at least a part of the aforementioned trimmed portion may be composed of an arc.

Moreover, at least a part of the edge portion other than the trimmed portion may be formed so as to be opposite to the ground pattern side of the planar element or so as not to face the ground pattern. For example, by separating into the ground pattern side and the planar element side, the miniaturization can be achieved. Thus, if the planar element side and the ground pattern side are separated, other parts (for example, a RF (Radio Frequency) circuitry) can be mounted on the ground pattern, thereby the miniaturization can entirely be achieved.

In addition, the aforementioned ground pattern may be formed so as to have an opening for at least a part of the edge portion other than the trimmed portion. The external form of the ground pattern is adjusted according to various factors; however, the ground pattern may be formed so as not to be directly opposite to at least a part of the edge portion other than the trimmed portion.

Furthermore, the planar element may have a cut-out portion formed at the edge portion opposite to the ground pattern side of the planar element. The cut-out portion may be formed from the edge portion farthest from the feed point toward the ground pattern side. This achieves the miniaturization of the planar element and the improvement of the characteristic in the low frequency range.

Incidentally, at least a part of the edge portion including the cut-out portion may be formed at a position that is not opposite to the ground pattern.

In addition, a tapered shape with respect to the feed point of the planar element may be formed at the ground pattern. This is because the coupling degree between the ground pattern and the planar element is adjusted to widen the bandwidth.

Incidentally, the planar element may be symmetric with respect to a straight line passing through the feed point of the planar element. In addition, the distance between the ground pattern and the planar element may be symmetric with respect to the straight line passing the feed point of the planar element.

Furthermore, the planar element may be formed on a dielectric substrate and the distance with the ground pattern may be saturatedly increased at the trimmed portion as being farther away from the feed point of the planar element.

Incidentally, the planar element may be formed on a resin substrate.

An antenna according to a second aspect of the invention comprises a ground pattern; and a planar element that has a feed point and whose edge portion opposite to the ground pattern has a trimmed portion that makes a distance with the ground pattern vary and is composed of at least either one of a curved line and line segments which are connected while their inclinations are changed stepwise, and the ground pattern is disposed without fully surrounding the edge portion of the planar element, and the planar element and the ground pattern are disposed without complete overlap with each other, and both planes thereof are parallel or substantially parallel to each other. The plane of the ground pattern and the plane of the planar element are disposed in a non-opposite state, and both the planes are parallel or substantially parallel to each other.

An antenna according to a third aspect of the invention comprises a ground pattern; and a planar element that has a feed point and whose edge portion opposite to the ground pattern has a trimmed portion at which a distance with the ground pattern is gradually increased from the feed point, and the ground pattern is juxtaposed with the planar element without fully surrounding the edge portion of the planar element.

BRIEF DESCRIPTION OF THE DRAWINGS

FIGS. 16A-1, 16A-2, 16B-1, 16B-2, 16C, 16D, 16E, 16F, 16G, 16H, and 16I are diagrams showing the structures of conventional antennas;

DETAILE DESCRIPTION OF THE PREFERRED EMBODIMENTS

Preferred embodiments according to the present invention will be described with reference to the accompanying drawings.

1. First Embodiment

Figure 1A:
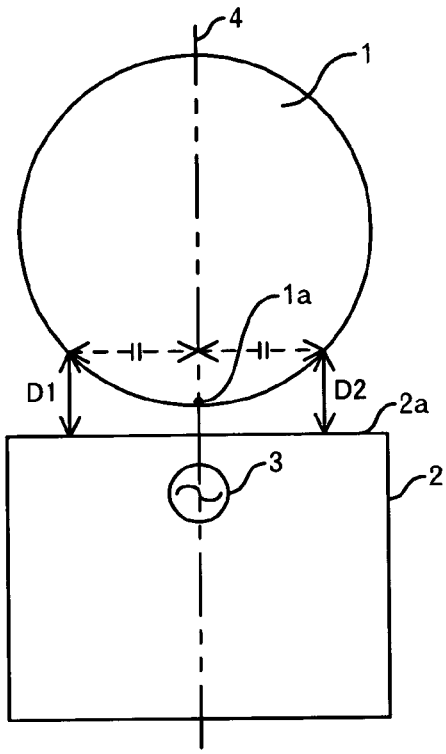
FIG. 1A is a front view showing the structure of an antenna according to a first embodiment.
Figure 1B:
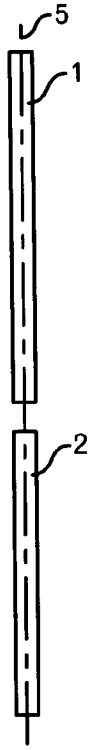
FIG. 1B is a side view of the antenna shown in FIG. 1A.

The structure of an antenna according to a first embodiment of the present invention is shown in FIG. 1A and FIG. 1B. As shown in FIG. 1A, the antenna according to the first embodiment is composed of a planar element 1, which is a circular flat conductor, a ground pattern 2 juxtaposed with the planar element 1, and a high frequency power source 3. The planar element 1 is connected with the high frequency power source 3 at a feed point 1*a*. The feed point 1*a* is located at such a position that the distance between the planar element 1 and the ground pattern 2 is shortest.

Moreover, the planar element 1 and the ground pattern 2 are designed symmetrically with respect to a line 4 passing through the feed point 1*a*. Accordingly, the shortest distance from any point on the arc of the planar element 1 to the ground pattern 2 is also designed to be symmetrical with respect to the line 4. That is, if the distance from the line 4 to each of two points on the arc of the planar element 1 is the same, the shortest distances D1 and D2 from each of the two points on the arc of the planar element 1 to the ground pattern 2 are the same.

In this embodiment, a side 2*a* of the ground pattern 2 opposite to the edge of the planar element 1 is a line. Accordingly, the shortest distance between an arbitrary point on the downward arc of the planar element 1 and the side 2*a* of the ground pattern 2 increases curvedly along the arc as being farther away from the feed point 1*a*.

Moreover, according to this embodiment, the planar element 1 is disposed on the center line 5 of the ground pattern 2 as shown in FIG. 1B. Accordingly, in this embodiment, the planar element 1 and the ground pattern 2 are located on the same plane. However, they are not necessarily located on the same plane, and they may be disposed so that the planes thereof are parallel or substantially parallel to each other.

Incidentally, in this embodiment, the ground pattern 2 is formed without surrounding the planar element 1, and the antenna is separated into the ground pattern 2 side and the planar element 1 side up and down. In other words, they extend along counter directions respectively. That is, though the size of a certain degree is necessary, the ground pattern 2 can be formed regardless of the size of the planar element 1. Further, by providing an electrical insulation layer, other parts can be mounted on the ground pattern 2. Accordingly, the substantial size of the antenna is determined according to the size of the planar element 1. In addition, the upward arc of the planar element 1, which is opposite to the downward arc, is an edge portion that does not directly face the ground pattern 2, and though it depends on the installation place or the like, at least a part of this portion is not surrounded by the ground pattern 2, and is disposed so as to face toward a direction of an opening provided at the ground pattern 2.

Figure 2:
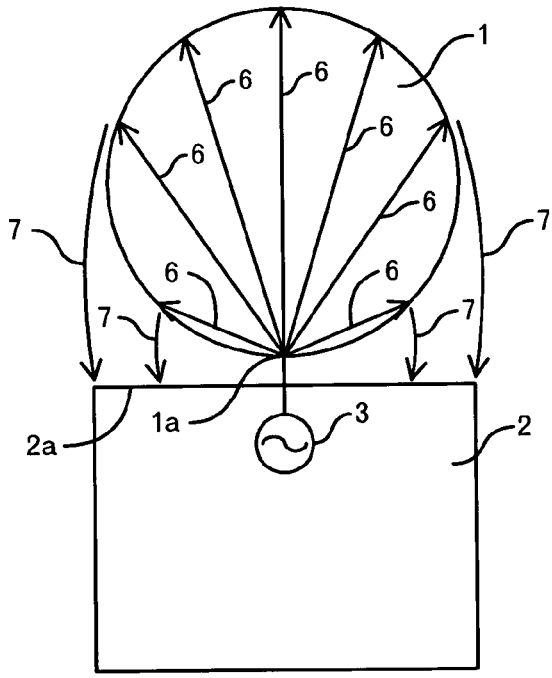
FIG. 2 is a diagram to explain the principle of the operation of the antenna according to the first embodiment.

As for the operation principle of the antenna shown in FIGS. 1A and 1B, each current path 6 spreading radially from a feed point 1*a* to the circumference of the planar element 1 forms a resonance point as shown in FIG. 2. Therefore, continuous resonance characteristics can be achieved, and the bandwidth can be widened. In the case of FIGS. 1A and 1B, since the current path corresponding to the diameter of the planar element 1 is longest, the frequency at which the length of the diameter corresponds to a quarter wavelength is almost equal to the lower limit frequency and such continuous resonance characteristics can be achieved at the lower limit frequency or more. Therefore, electromagnetic coupling 7 due to current flowing on the planar element 1 occurs between the circular planar element 1 and the ground pattern 2 as shown in FIG. 2. That is, when the frequency is lower, the current path 6 contributing to the radiation erects vertically to a side 2*a* of the ground pattern 2, and coupling occurs in a wide range between the circular planar element 1 and the ground pattern 2. On the other hand, when the frequency is higher, the current path is inclined toward the horizontal direction, so that coupling occurs between the planar element 1 and the ground pattern 2 in a narrow range. It is considered that the coupling between the circular planar element 1 and the ground pattern 2 corresponds to a capacitance component C in an impedance equivalent circuit of an antenna, and the value of the capacitance component C varies in accordance with the degree of inclination of the current path. When the value of the capacitance component C varies, it greatly affects the impedance characteristic of the antenna. More specifically, the capacitance component C relates to the distance between the circular planar element 1 and the ground pattern 2. On the contrary, when the disc is erected vertically to the ground surface, the distance between the ground surface and the disc cannot be minutely controlled. On the other hand, when the planar element 1 is juxtaposed with the ground pattern 2 as shown in FIGS. 1A and 1B, the capacitance component C in the impedance equivalent circuit of the antenna can be changed by altering the shape of the ground pattern 2. Accordingly, the antenna can be designed to achieve a preferable antenna characteristic.

Figure 3:
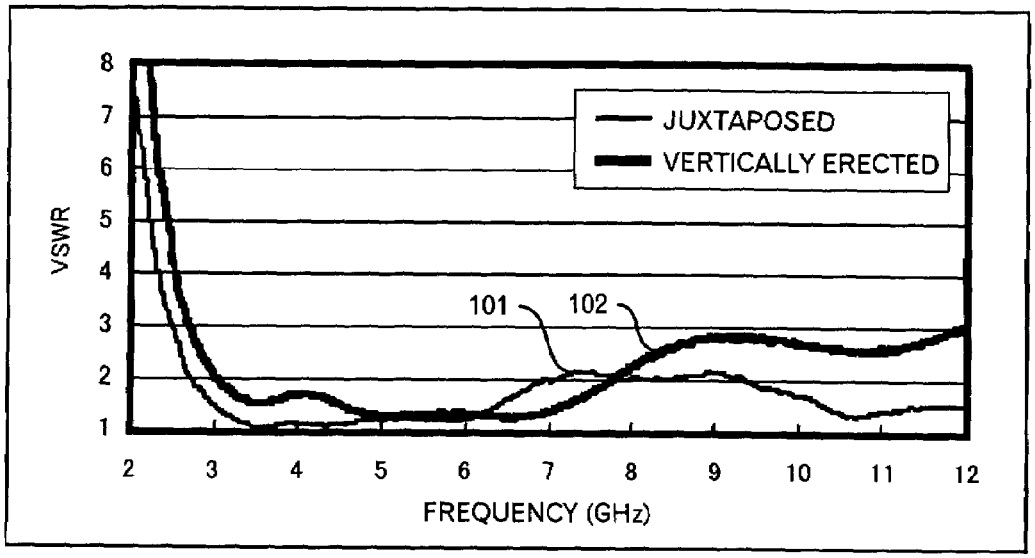
FIG. 3 is a diagram to compare the impedance characteristics of the antenna in the first embodiment of the invention and an antenna according to the background art.

Moreover, comparing with a case where the disc is erected vertically to the ground surface, there is an effect in which the bandwidth can be further widened. FIG. 3 shows a graph whose axis of ordinate represents VSWR, and whose axis of abscissa represents the frequency (GHz). The solid line 101 represents the characteristic in this embodiment, and the thick line 102 represents the characteristic in the technology in which the disc is erected vertically to the ground surface. Apparently, the value of VSWR in the background art is worse in a high frequency range not less than 8 GHz. On the other hand, as for this embodiment, though there are ranges in which the value of VSWR becomes bad partially, the value of VSWR is less than 2 even in the high frequency range more than 10 GHz. Thus, not only the effect in which the distance between the planar element 1 and the ground pattern 2 is easily controlled, but also the effect in which the bandwidth is stably widened can be achieved by the "juxtaposition" of the planar element 1 and the ground pattern 2.

Incidentally, the planar element 1 of this embodiment may be considered as a radiation conductor of a monopole antenna. On the other hand, since the ground pattern 2 of the antenna of this embodiment partially contributes to radiation, the antenna of this embodiment is also considered as a dipole antenna. However, since the dipole antenna normally uses two radiation conductors having the same shape, the antenna of this embodiment may be called as an asymmetrical dipole antenna. Furthermore, the antenna of this embodiment is considered as a traveling wave antenna. Such considerations can be applied to all the embodiments described below.

2. Second Embodiment

Figure 4:
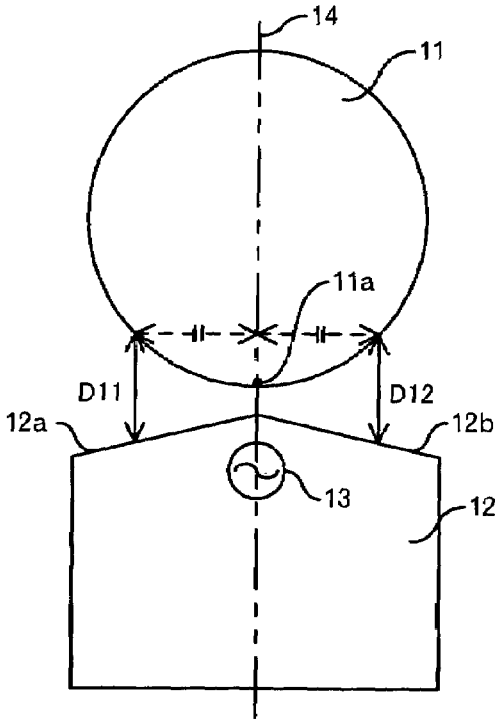
FIG. 4 is a diagram showing the structure of an antenna according to a second embodiment.

The structure of an antenna according to a second embodiment of the present invention is shown in FIG. 4. Similarly to the first embodiment, this antenna is composed of a planar element 11, which is a circular conductive plate, a ground pattern 12 juxtaposed with the planar element 11, and a high frequency power source 13 connected to a feed point 11*a* of the planar element 11. The feed point 11*a* is located at such a position that the distance between the planar element 11 and the ground pattern 12 is shortest.

Besides, the planar element 11 and the ground pattern 12 are symmetrical with respect to a straight line 14 passing through the feed point 11*a*. Furthermore, the length (hereinafter referred to as "distance") of a line segment extending from any point on the arc of the planar element 11 to the ground pattern 12 in parallel with the line 14 is also symmetric with respect to the line 14. That is, if the distances from the straight line 14 are the same, the distances D11 and D12 extending from any point of the arc of the planar element 11 to the ground pattern are the same.

In this embodiment, sides 12*a* and 12*b* of the ground pattern 12, which face the planar element 11, are inclined so that the distance between the planar element 11 and the ground pattern 12 is further gradually increased as being farther away from the straight line 14. That is, at the ground pattern 12, a tapered shape is formed with respect to the feed point 11*a* of the planar element 11. Therefore, the distance between the planar element 11 and the ground pattern 12 is gradually and curvedly increased more than a curved line defined by the arc of the planar element 11. Incidentally, the inclination of the sides 12*a* and 12*b* must be adjusted to obtain the desired antenna characteristic.

Namely, as described in the first embodiment, by changing the distance between the planar element 11 and the ground pattern 12, it is possible to change the capacitance component C in the impedance equivalent circuit of the antenna. As shown in FIG. 4, the gap between the planar element 11 and the ground pattern 12 is widened outwardly, and therefore, the volume of the capacitance component C becomes small as compared with the first embodiment. Accordingly, the inductance component L in the impedance equivalent circuit becomes relatively effective. Thus, by controlling the impedance, the desired antenna characteristic can be obtained. The antenna shown in FIG. 4 also achieves the wide bandwidth.

Also in this embodiment, the ground pattern 12 is formed without surrounding the planar element 11 and the antenna is separated into the ground pattern 12 side and the planar element 11 side up and down. In other words, they extend along counter directions respectively. In addition, the upward arc of the planar element 11, which is opposite to the downward arc, is an edge portion that does not directly face the ground pattern 12, and though it depends on the installation place or the like, at least a part of this portion is not surrounded by the ground pattern 12.

Incidentally, according to this embodiment, the planar element 11 and the ground pattern 12 are disposed on the same plane like the first embodiment. However, they are not necessarily located on the same plane, and they may be disposed so that the planes thereof are parallel or substantially parallel to each other.

3. Third Embodiment

Figure 5:
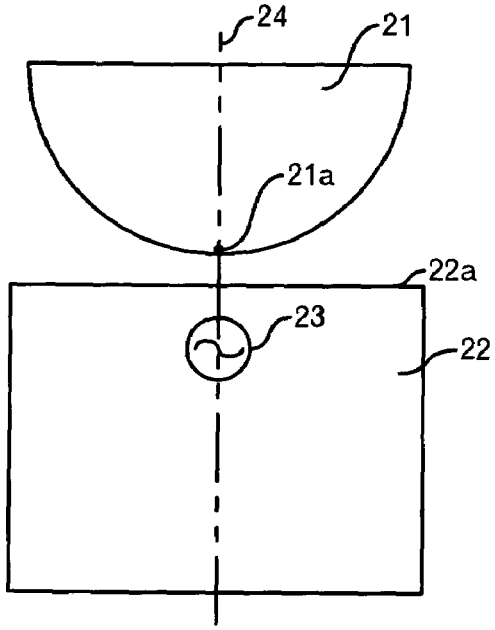
FIG. 5 is a diagram showing the structure of an antenna according to a third embodiment.

The structure of an antenna according to a fifth embodiment of the present invention is shown in FIG. 5. The antenna according to this embodiment is composed of a planar element 21, which is a semicircular conductive flat plate, a ground pattern 22 juxtaposed with the planar element 21, and a high frequency power source 23 connected with a feed point 21*a* of the planar element 21. The feed point 21*a* is located at a position in which the distance between the planar element 21 and the ground pattern 22 is shortest.

Moreover, the planar element 21 and the ground pattern 22 are designed symmetrically with respect to a line 24 passing through the feed point 21*a*. Accordingly, the shortest distance from any point on the arc of the planar element 21 to the ground pattern 22 is also designed to be symmetrical with respect to the line 24. That is, if the distance from the line 24 to each of two points on the arc of the planar element 21 is the same, the shortest distance from each of the two points on the arc of the planar element 21 to the ground pattern 22 is the same.

In this embodiment, a side 22*a* of the ground pattern 22 opposite to the edge of the planar element 21 is a straight line. Accordingly, the shortest distance between arbitrary point on the arc of the planar element 21 and the side 22*a* of the ground pattern 22 increases curvedly along the arc as being farther away from the feed point 21*a*.

Moreover, in this embodiment, the planar element 21 and the ground pattern 22 are located on the same plane similarly to the first embodiment. However, they are not necessarily located on the same plane, and they may be disposed so that the planes thereof are parallel or substantially parallel to each other.

Also in this embodiment, the ground pattern 22 is formed without surrounding the planar element 21, and the antenna is separated into the ground pattern 22 side and the planar element 21 side up and down. In other words, they extend along counter directions respectively. In addition, the straight line of the planar element 21, which is opposite to the downward arc, is an edge portion that does not directly face the ground pattern 22, and though it depends on the installation place or the like, an opening toward the outside of the antenna is formed at the ground pattern 22 for at least a part of this portion.

The frequency characteristic of the antenna in this embodiment can be controlled by the radius of the planar element 21 and the distance between the planar element 21 and the ground pattern 22. By the radius of the planar element 21, the lower limit frequency is almost determined. Incidentally, similarly to the second embodiment, it is possible to change a form of the ground pattern 22 so as to be tapered. The wide bandwidth is achieved also in this antenna of this embodiment.

4. Fourth Embodiment

Figure 6:
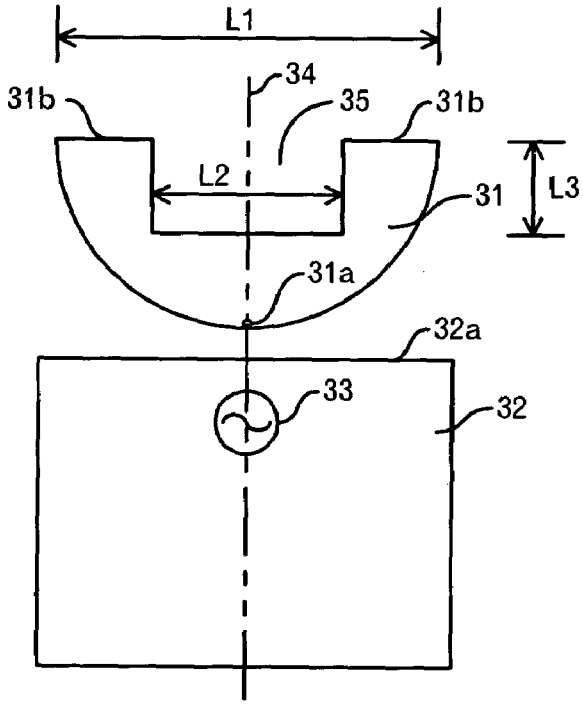
FIG. 6 is a diagram showing the structure of an antenna according to a fourth embodiment.

The structure of an antenna according to a fourth embodiment of the present invention is shown in FIG. 6. The antenna according to this embodiment is composed of a planar element 31 formed of a semicircular conductive flat plate and having a cut-out portion 35, a ground pattern 32 juxtaposed with the planar element 31, and a high-frequency power source 33 connected to a feed point 31*a* of the planar element 31. The diameter L1 of the planar element 31 is set to 20 mm, for example. The aperture L2 of the cut-out portion 35 is set to 10 mm, for example, and the rectangular concavity whose depth is L3 (=5 mm) is formed from the top portion 31*b* (i.e. the edge portion farthest from the feed point 31*a*) of the planar element 31 toward the ground pattern 32 side, for example. The feed point 31*a* is located at such a position that the distance between the planar element 31 and the ground pattern 32 is shortest.

The planar element 31 and the ground pattern 32 are designed symmetrically with respect to a line 34 passing through the feed point 31*a*, and also the cut-out portion 35 is designed to be symmetrical with respect to the line 34. Furthermore, the shortest distance from any point on the arc of the planar element 31 to the ground pattern 32 is also symmetrical with respect to the line 34. That is, if the distance from the line 34 to each of two points on the arc of the planar element 31 is the same, the shortest distance from each of the two points on the arc of the planar element 31 to the ground pattern 32 is the same.

In this embodiment, a side 32*a* of the ground pattern 32 opposite to the edge of the planar element 31 is a line. Accordingly, the shortest distance between arbitrary point on the arc of the planar element 31 and the side 32*a* of the ground pattern 32 gradually increases curvedly along the arc as being farther away from the feed point 31*a*.

Moreover, the side of the antenna according to this embodiment is the same as FIG. 1B, and the planar element 31 is disposed on the center line of the ground pattern 32. That is, in this embodiment, the planar element 31 and the ground pattern 32 are located on the same plane. However, they are not necessarily located on the same plane, and they may be disposed so that the planes thereof are parallel or substantially parallel to each other.

Furthermore, according to this embodiment, the planar element 31 is disposed so that the edge portion of the planar element 31 other than the cut-out portion 35 provided in the planar element 31 is opposite to the edge of the ground pattern 32. On the contrary, the edge portion of the planar element 1 at which the cut-out portion 35 is provided is not opposite to the edge of the ground pattern 32, and also is not surrounded by the ground pattern 32. That is, since the planar element 31 portion and the ground pattern 32 portion are clearly separated from each other up and down, it is unnecessary to provide an useless area of the ground pattern 32 and the miniaturization is facilitated. In addition, if the ground pattern 32 portion and the planar element 31 portion are separated from each other, other parts can be mounted on the ground pattern 32, thereby the miniaturization can be also enhanced as the entire communication device.

Next, the operation principle of the antenna according to this embodiment is considered. Since the basic shape of the planar element is changed from the circular shape to the semicircular shape, the length of the current path is shorter than in the case where the circular planar element is used. Though some current paths are longer than the radius of the circle, the frequency at which the length of the radius of the circle corresponds to the quarter wavelength is almost equal to the lower limit frequency. Therefore, there occurs a problem that the characteristic especially in the low frequency range is lowered due to the effect of the miniaturization.

Figure 7:
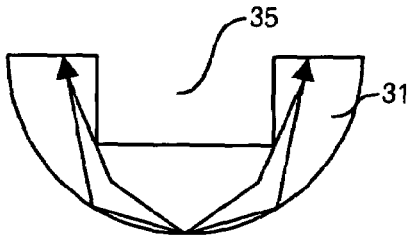
FIG. 7 is a diagram to explain the principle of the operation of the antenna according to the fourth embodiment.

Therefore, by providing the cut-out portion 35 for the planar element 31 like this embodiment, the current is prevented from linearly flowing from the feed point 31*a* to the top portion 31*b* by the cut-out portion 35, and detours around the cut-out portion 35 as shown in FIG. 7. As described above, since the current path is formed so as to detour around the cut-out portion 35, it becomes longer, and the lower limit frequency of the radiation can be lowered. Accordingly, the bandwidth can be widened.

With respect to the antenna of this embodiment, the antenna characteristic can be controlled by the shape of the cut-out portion 35 and the distance between the planar element 31 and the ground pattern 32. However, it has been known that it is impossible to control the antenna characteristic by the cut-out portion in such an antenna that a radiation conductor is erected vertically to the ground surface like the background art (see the non-patent document 1). On the other hand, if the planar element 31 and the ground pattern 32 are juxtaposed with each other like this embodiment, the antenna characteristic can be controlled by the cut-out portion 35.

Figure 8:
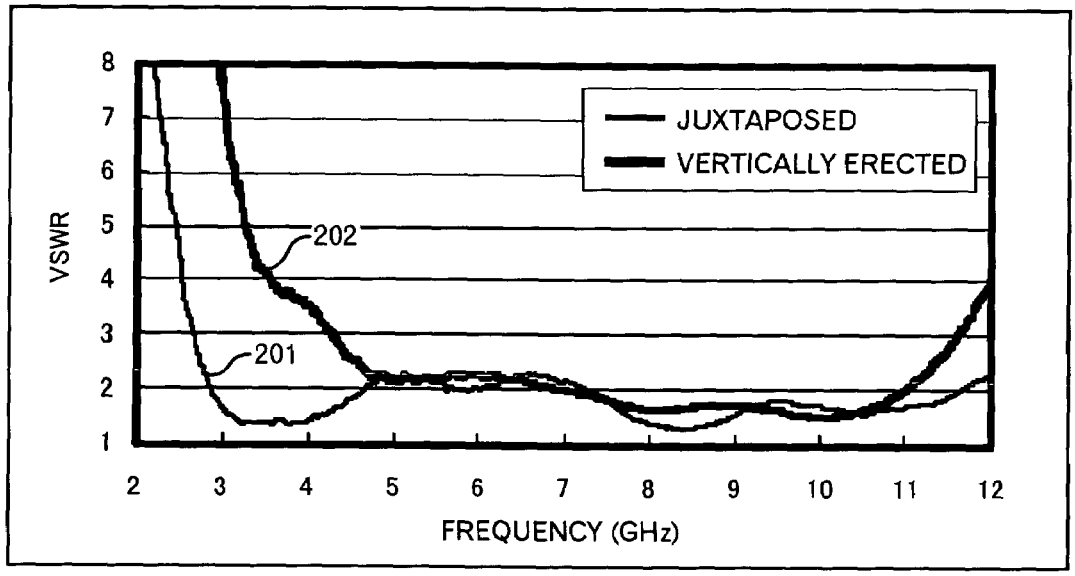
FIG. 8 is a diagram to compare the impedance characteristics of the antenna in the fourth embodiment of the invention and an antenna according to the background art.

FIG. 8 is a graph showing the impedance characteristic when the planar element 31 is erected vertically to the ground surface like the background art, and also the impedance characteristic of the antenna according to this embodiment shown in FIG. 6. In FIG. 8, the axis of ordinate represents VSWR, and the axis of abscissa represents the frequency (GHz). In the frequency characteristic of the antenna according to this embodiment represented by a solid line 201, the value of VSWR becomes less than 2 at a lower frequency than 3 GHz, and it is almost equal to about 2 until the frequency increases and exceeds 11 GHz although VSWR is slightly over 2 in the frequency range between 5

GHz and 7 GHz. On the other hand, in the frequency characteristic of the antenna according to the background art represented by a thick line 202, VSWR does not have the same values as this embodiment until the frequency reaches about 5 GHz, and the value of VSWR increases at a frequency of about 11 GHz. That is, the antenna of this embodiment exhibits a remarkable effect that the characteristic is more excellent in the low frequency range and the high frequency range.

As described above, there is not only an effect that the distance between the planar element 31 and the ground pattern 32 can be easily controlled, but also an effect that the bandwidth can be stably widened by the "juxtaposition" of the planar element 31 and the ground pattern 32. In addition, the planar element 1 can be miniaturized by the cut-out portion 35.

Incidentally, it is not shown, but the shape of the portion of the ground pattern 32, which is opposite to the edge of the planar element 31, may be changed so as to be tapered. The shape can control the antenna characteristic as well as the shape of the cut-out portion 35 in a desired style.

Furthermore, the shape of the cut-out portion 35 is not limited to the rectangular shape. For example, an inverted triangular cut-out portion 35 may be used. In this case, the feed point 31*a* and one apex of the inverted triangle are arranged to be located on the line 34. Still furthermore, the cut-out portion 35 may be designed in a trapezoidal shape. In the case of the trapezoid, if the bottom side is designed to be longer than the top side, the detour length at which the current path detours around the cut-out portion 35 is increased. Accordingly, the current path in the planar element 31 can be more increased. The corners of the cut-out portion 35 may be rounded.

5. Fifth Embodiment

Figure 9:
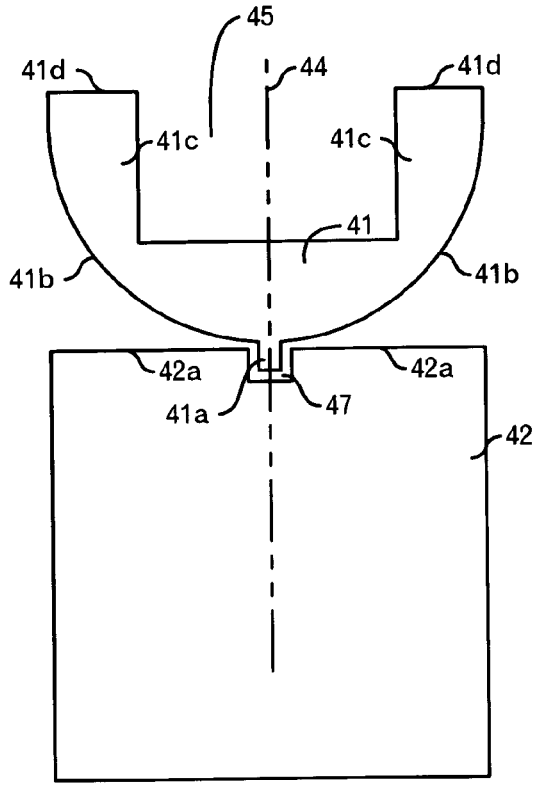
FIG. 9 is a diagram showing the structure of an antenna according to a fifth embodiment.

FIG. 9 shows the structure of an antenna according to a fifth embodiment of the present invention. In this embodiment, an example will be explained in which a planar element 41 which is formed of a semicircular conductive flat plate and is equipped with a cut-out portion 45, and a ground pattern 42 are formed on a printed circuit board (for example, FR-4, Teflon (registered trademark) or the like) having a dielectric constant of 2 to 5.

The antenna according to the fifth embodiment comprises the planar element 41, the ground pattern 42 juxtaposed with the planar element 41, and a high-frequency power source connected to the planar element 41. The high-frequency power source is omitted from the illustration of FIG. 9. The planar element 41 is equipped with a projecting portion 41*a* which is connected to the high-frequency power source and constitutes a feed point, a curved portion 41*b* opposite to a side 42*a* of the ground pattern 42, a rectangular cut-out portion 45 concaved from the top portion 41*d* toward the ground pattern 42, and arm portions 41 for securing current paths for low frequencies. The structure of the side is almost the same as FIG. 1B. That is, the planar element 41 and the ground pattern 42 do not completely overlap with each other, and both the planes thereof are parallel or substantially parallel to each other.

Also in this embodiment, the ground pattern 42 is formed without surrounding the planar element 41, and the antenna is separated into the ground pattern 42 side and the planar element 41 side up and down. In other words, they extend along counter directions respectively. In addition, the cut-out portion 45 and the top portion 41*d* of the planar element 41 are edge portions that is not directly opposite to the ground pattern 42, and though it depends on the installation place or the like, an opening toward the outside of the antenna is formed at the ground pattern 42 for at least a part of this portion.

The ground pattern 42 is equipped with a recess 47 in which the projecting portion 41*a* of the planar element 41 is accommodated. Accordingly, the side 42*a* opposite to the curved portion 41*b* of the planar element 41 is not straight, but is divided into two sides. The antenna according to this embodiment is designed to be symmetrical with respect to the line 44 passing through the center of the projecting portion 41*a*, which is the feed position. That is, the cut-out portion 45 is also symmetrical. The distance between the curved line 41*b* of the planar element 41 and the side 42*a* of the ground pattern 42 is gradually increased as being farther away from the line 44.

Incidentally, the shape of the cut-out portion 45 is not limited to the rectangle, and the shape of the cut-out portion as described with respect to the fourth embodiment may be adopted.

Figure 10:
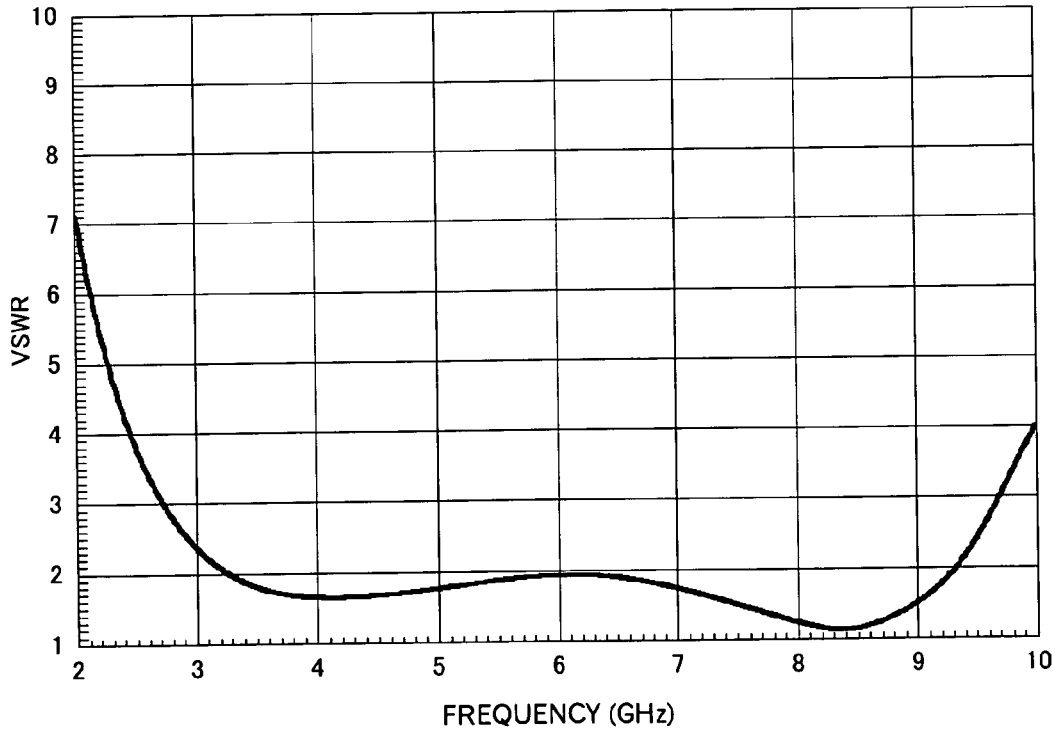
FIG. 10 is a diagram showing the characteristic of an antenna according to the fifth embodiment.

FIG. 10 is a graph showing the impedance characteristic of the antenna according to this embodiment. In FIG. 10, the axis of ordinate represents VSWR and the axis of abscissa represents the frequency (GHz). Since the frequency range in which VSRW is not more than 2.5 extends from about 2.9 GHz to about 9.5 GHz, this embodiment has achieved a wide bandwidth antenna. The value of VSWR approaches 2 at about 6 GHz, however, this is permissible. The frequency at which VSWR becomes 2.5 is an extremely low frequency (i.e. about 2.9 GHz) because the cut-out portion 45 is provided.

6. Sixth Embodiment

Figure 11A:
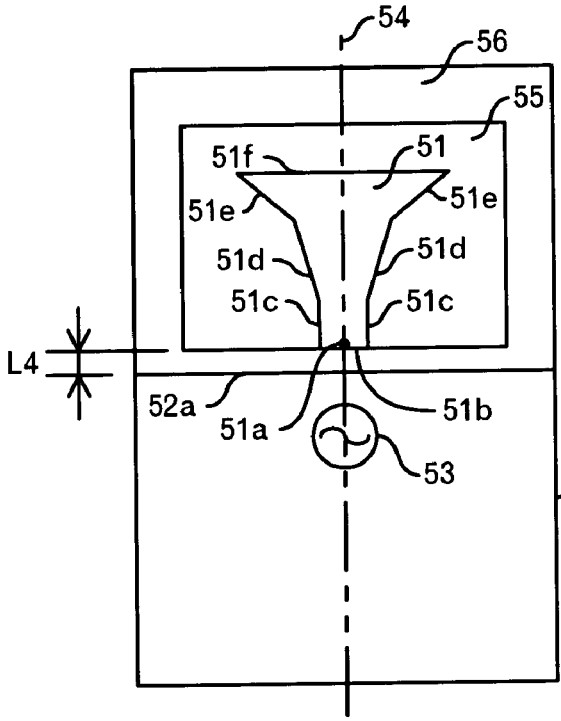
FIG. 11A is a front view showing the structure of an antenna according to a sixth embodiment.
Figure 11B:
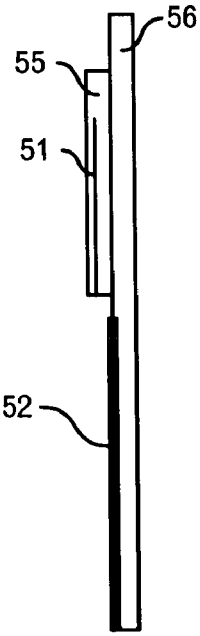
FIG. 11B is a side view of the antenna shown in FIG. 11A.

FIGS. 11A and 11B show the structure of an antenna according to a sixth embodiment of this invention. As shown in FIG. 11A, the antenna of this embodiment is constituted by a dielectric substrate 55 including a planar element 51 in the inside thereof and having a dielectric constant of about 20, a ground pattern 52 juxtaposed with the dielectric substrate 55, a board 56, for example, a printed circuit board and a high frequency power source 53 connected to a feed point 51*a* of the planar element 51. The planar element 51 has a shape similar to a T shape, and is constituted by a bottom side 51*b* along an end portion of the dielectric substrate 55, sides 51*c* extending upward, sides 51*d* having a first inclination angle from the sides 51*c*, sides 51*e* having an inclination angle larger than the first inclination angle from the sides 51*c*, and a top portion 51*f*. The feed point 51*a* is provided at the middle point of the bottom side 51*b* along the end portion of the dielectric substrate 55. In this embodiment, a distance L1 between the dielectric substrate 55 and the ground pattern 52 is 1.5 mm. Besides, the width of the ground pattern 52 is 20 mm.

Besides, the planar element 51 and the ground pattern 52 are symmetrical with respect to a straight line 54 passing through the feed point 51*a*. Besides, a length (hereinafter referred to as a distance) of a line segment extending from a point on the sides 51*c*, 51*d* and 51*e* of the planar element 51 to the ground pattern 52 in parallel to the straight line 54 is symmetrical with respect to the straight line 54. That is, when lengths from the straight line 54 are identical, the distances become identical.

In this embodiment, a side 52*a* of the ground pattern 52 facing the dielectric substrate 55 is a straight line. Accordingly, the distance is gradually increased as an arbitrary point on the sides 51*c*, 51*d* and 51*e* moves on the sides 51*c*, 51*d* and 51*e*. That is, as the arbitrary point moves away from the straight line 54, the distance is increased.

Although a polygonal line constituted by connecting the sides 51*c*, 51*d* and 51*e* is not a curved line, the inclination of each side is changed stepwise so that the distance is increased to become saturated. In other words, when the point moves away from the straight line 54 along the polygonal line, although the distance is rapidly increased at first, the increase rate is gradually decreased. That is, the shape is such that shaving is performed inward from a straight line connecting an end point of the top portion 51*f* and an end point of the bottom side 51*b*, which are positioned at the same side when viewed from the straight line 54.

In this embodiment, the side edge portion of the planar element opposite to the side 52*a* of the ground pattern 52 is constituted by the three line segments 51*c*, 51*d* and 51*e*. However, as long as the condition that the distance is increased to become saturated is satisfied, the shape of the inclined sides is not limited to this. Instead of the sides 51*c*, 51*d* and 51*e*, a polygonal line constituted by an arbitrary number of line segments not less than two may be adopted. Besides, instead of the sides 51*c*, 51*d* and 51*e*, the side edge portion may be a curved line convex upwardly with respect to the straight line connecting the end point of the top portion 51*f* and the end point of the bottom side 51*b*, which are positioned at the same side when viewed from the straight line 54. That is, when viewed from the planar element 51, the curved line is convex inwardly.

Even when any shape is adopted, as the point moves away from the straight line 54 along the sides 1*c*, 1*d* and 1*e*, the distance continuously varies, and by the existence of the continuous varying portion, a continuous resonance characteristic can be obtained at the lower limit frequency or higher.

FIG. 11B is a side view in which the ground pattern 52 and the dielectric substrate 55 are provided on the board 56. The plane of the planar element 51 in the dielectric substrate 55 is disposed to be parallel or in substantially parallel to the plane of the ground pattern 52. There is also a case where the substrate 56 and the ground pattern 52 are integrally formed. Incidentally, in this embodiment, the planar element 51 is formed in the inside of the dielectric substrate 55. That is, the dielectric substrate 55 is formed by laminating ceramic sheets, and the conductive planar element 51 is also formed as one layer of them. Accordingly, actually, even if viewed from the above, it cannot be viewed as in FIG. 11A. When the planar element 51 is constructed in the inside of the dielectric substrate 55, as compared with a case of exposure, an effect of the dielectric is slightly enhanced, and therefore, the miniaturization can be achieved, and the reliability and/or resistance against rust or the like is also increased. However, the planar element 51 may be formed on the surface of the dielectric substrate 55. Besides, the dielectric constant can also be changed, and either of a single layer substrate and a multi-layer substrate may be used. In the case of the single layer substrate, the planar element 51 is formed on the dielectric substrate. Incidentally, also in this embodiment, the ground pattern 52 does not surround the dielectric substrate 55 including the planar element 51, and the ground pattern 52 side and the dielectric substrate 55 side are separated form each other up and down.

As stated above, when the planar element 51 is formed so as to be covered with the dielectric substrate 55, the state of an electromagnetic field around the planar element 51 is changed by the dielectric. Specifically, since an effect of increasing the density of the electric field in the dielectric and a wavelength shortening effect can be obtained, the planar element 51 can be miniaturized. Besides, by these effects, a lift-off angle of a current path is changed, and an inductance component L and a capacitance component C in an impedance equivalent circuit of the antenna are changed. That is, a great influence occurs on the impedance characteristic. When the shape is optimized so as to obtain a desired impedance characteristic in the bandwidth from 4.9 GHz to 5.8 GHz in consideration of the influence on this impedance characteristic, the shape as shown in FIG. 11A has been obtained. This bandwidth is very wide as compared with the background art.

7. Seventh Embodiment

Figure 12:
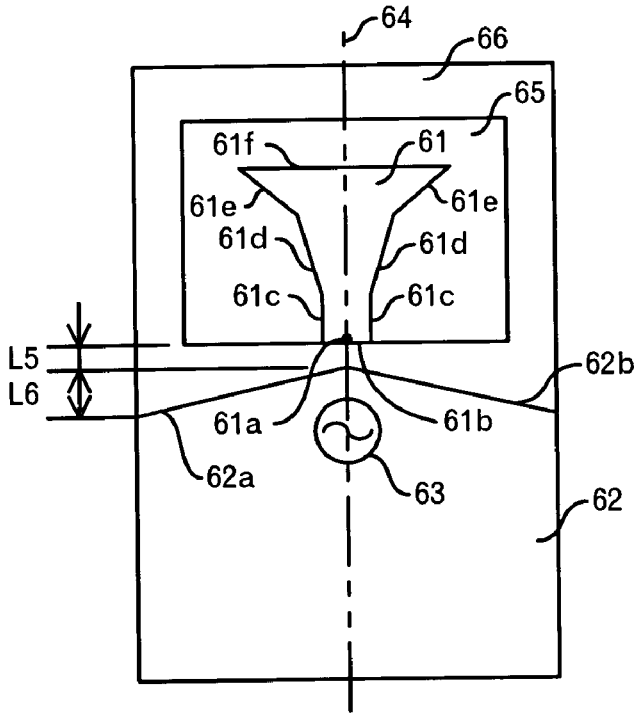
FIG. 12 is a diagram showing the structure of an antenna according to a seventh embodiment.

FIG. 12 shows the structure of an antenna of a seventh embodiment of this invention. As shown in FIG. 12, the antenna of this embodiment is constituted by a dielectric substrate 65 including a planar element 61 in the inside thereof and having a dielectric constant of about 20, a ground pattern 62 juxtaposed with the dielectric substrate 65, a board 66, for example, a printed circuit board, and a high frequency power source 63 connected to a feed point 61*a* of the planar element 61. The planar element 61 and the dielectric substrate 65 are the same as the planar element 51 and the dielectric substrate 55 according to the sixth embodiment. In this embodiment, a distance L2 between the dielectric substrate 65 and the ground pattern 62 is 1.5 mm. Besides, the width of the ground pattern 62 is 20 mm.

Besides, the planar element 61 and the ground pattern 62 are symmetrical with respect to a straight line 64 passing through the feed point 61*a*. Besides, a length (hereinafter referred to as a distance) of a line segment extending from a point on sides 61*c*, 61*d* and 61*e* of the planar element 61 to the ground pattern 62 in parallel to the straight line 64 is also symmetrical with respect to the straight line 64. That is, when lengths from the straight line 64 are identical, the distances become identical.

In this embodiment, sides 62*a* and 62*b* of the ground pattern 62 facing the dielectric substrate 65 are inclined so that as the point moves away from the straight line 64 along the sides 61*c*, 61*d* and 61*e*, the distance between the planar element 61 and the ground pattern 62 becomes long. In this embodiment, the height at the side edge portion of the ground pattern 62 is lower than the height of a cross point of the ground pattern and the straight line 64 by a length L6 (=2 to 3 mm). That is, the ground pattern 62 has a tapered shape formed of the upper edge portions 62*a* and 62*b* with respect to the dielectric substrate 65. The structure of the side surface is similar to FIG. 11B. That is, the plane of the planar element 51 in the dielectric substrate 65 is disposed to be parallel or substantially parallel to the plane of the ground pattern 62. Incidentally, also in this embodiment, the ground pattern 62 does not surround the dielectric substrate 65 including the planar element 61, and the ground pattern 62 side and the dielectric substrate 65 side are separate from each other up and down.

It is confirmed that when the sides 62*a* and 62*b* of the ground pattern 62 are inclined as in this embodiment, in the bandwidth from 4.9 GHz to 5.8 GHz, the impedance characteristic is better than the antenna of the sixth embodiment.

8. Eighth Embodiment

Figure 13:
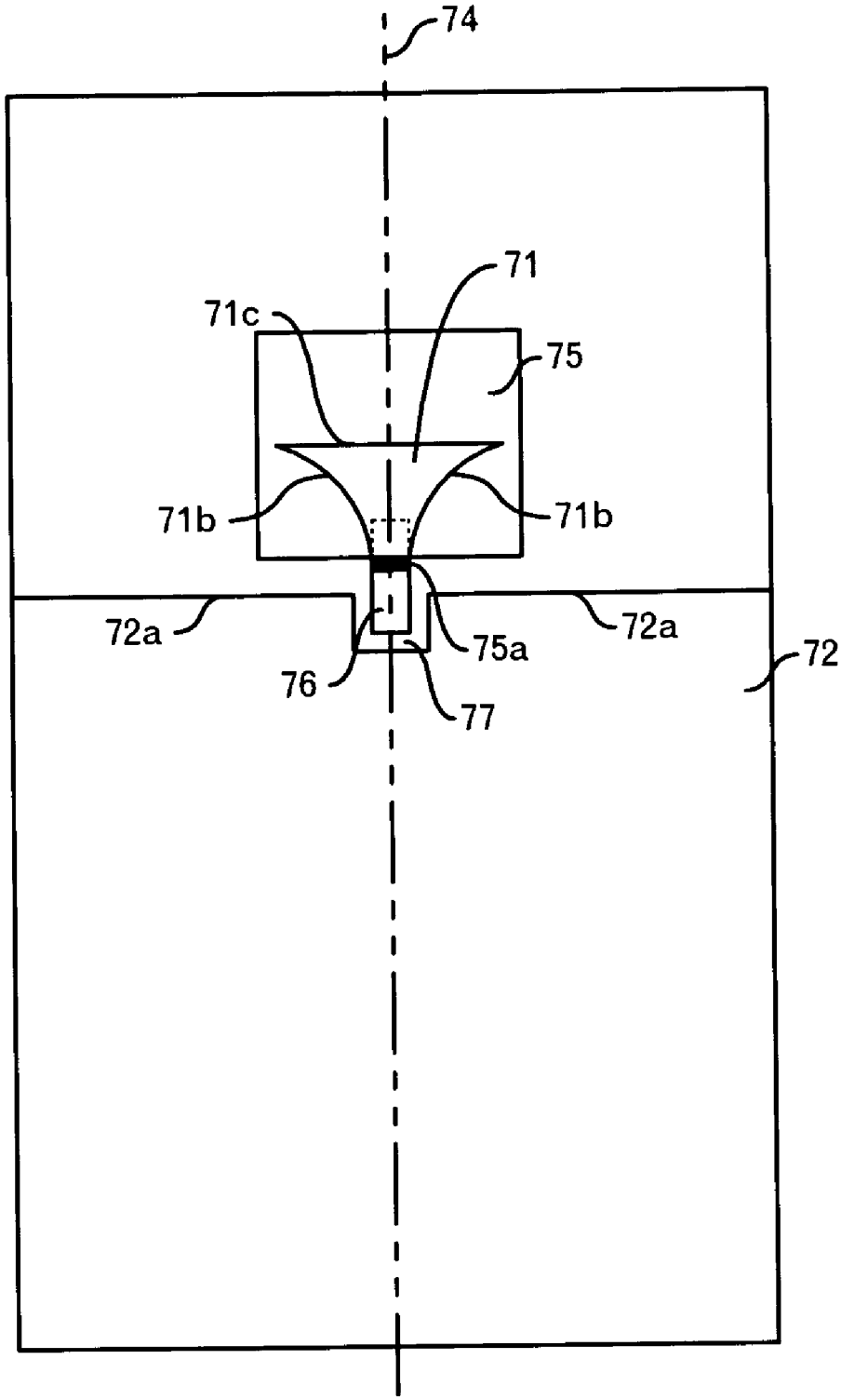
FIG. 13 is a diagram showing the structure of an antenna according to an eighth embodiment.

The structure of an antenna according to the eighth embodiment of the invention is shown in FIG. 13. In this embodiment, an example of a wide bandwidth antenna in the 5 GHz range is explained. The antenna according to the eighth embodiment is composed of a dielectric substrate 75, which includes a planar element having a shape similar to a T-type shape inside, and to which an outside electrode 75*a* is provided outside, a feeding portion 76 to connect with the outside electrode 75*a* of the dielectric substrate 75 and to connect with a high frequency power source, which is omitted to illustrate in FIG. 13, to feed power to the planar element 71, and a ground pattern 72 that has a recess 77 accommodating the feed portion 76 and is formed on a printed circuit board or the like. The outside electrode 75*a* is connected with a lower portion of the planar element 76 and extends to the back surface (i.e. dotted line portion of the back surface) of the dielectric substrate 76. The feed portion 76 contacts with the external electrode 75*a* that is provided on the end portion of the side surface and the back surface of the dielectric substrate 75, and the feed portion 76 and the external electrode 75*a* are overlapped in the dotted line portion.

The planar element 71 has an edge portion connected with the external electrode 75*a*, a curved line 71*b* opposite to the side 72*a* of the ground pattern 72, and a top portion 71*c*. Incidentally, the dielectric substrate 75 including the planar element 71 is juxtaposed with the ground pattern 72.

Incidentally, in this embodiment, the planar element 71 is formed inside the dielectric substrate 75. That is, the dielectric substrate 75 is formed by laminating ceramic sheets, and the conductive planar element 71 is formed as one layer of the laminate. Accordingly, when the antenna is viewed from the upper side, it is not actually viewed like FIG. 13. However, the planar element 71 may be formed on the surface of the dielectric substrate 75.

Since the recess 77 for accommodating the feed portion 76 is provided for the ground pattern 72, the side 72*a* opposite to the planar element 71 is not straight, and is divided into two sides. Incidentally, the antenna according to this embodiment is symmetric with respect to a straight line 74 passing through the center of the feed portion 76. The distance between sides 71*b* of the planar element 71 and the sides 72*a* becomes longer as being father away along the curved lines of the sides 71*b* from the straight line 74. This distance is symmetric with respect to the straight line 74. However, since the side 71*b* is convex inwardly toward the planar element 71, the distance becomes saturated as being farther away from the straight line 74. In other words, as being farther away from the straight line 74, although the distance rapidly increases at first, the increase rate is gradually decreased. Incidentally, the structure of the side surface is almost similar to that shown in FIG. 11B except for the external electrode 75*a* and portions of the recess 77 and the feed portion 76. That is, the plane of the dielectric substrate 75 including the planar element 71 is disposed to be parallel or substantially parallel to the plane of the ground pattern 72. That is, the ground pattern 72 and the planar element 71 are not completely overlapped, and both the planes thereof are parallel or substantially parallel to each other.

Also in this embodiment, the ground pattern 72 does not surround the dielectric substrate 75 including the planar element 71, and the ground pattern 72 side and the dielectric substrate 75 side are separated form each other up and down.

9. Ninth Embodiment

Figure 14:
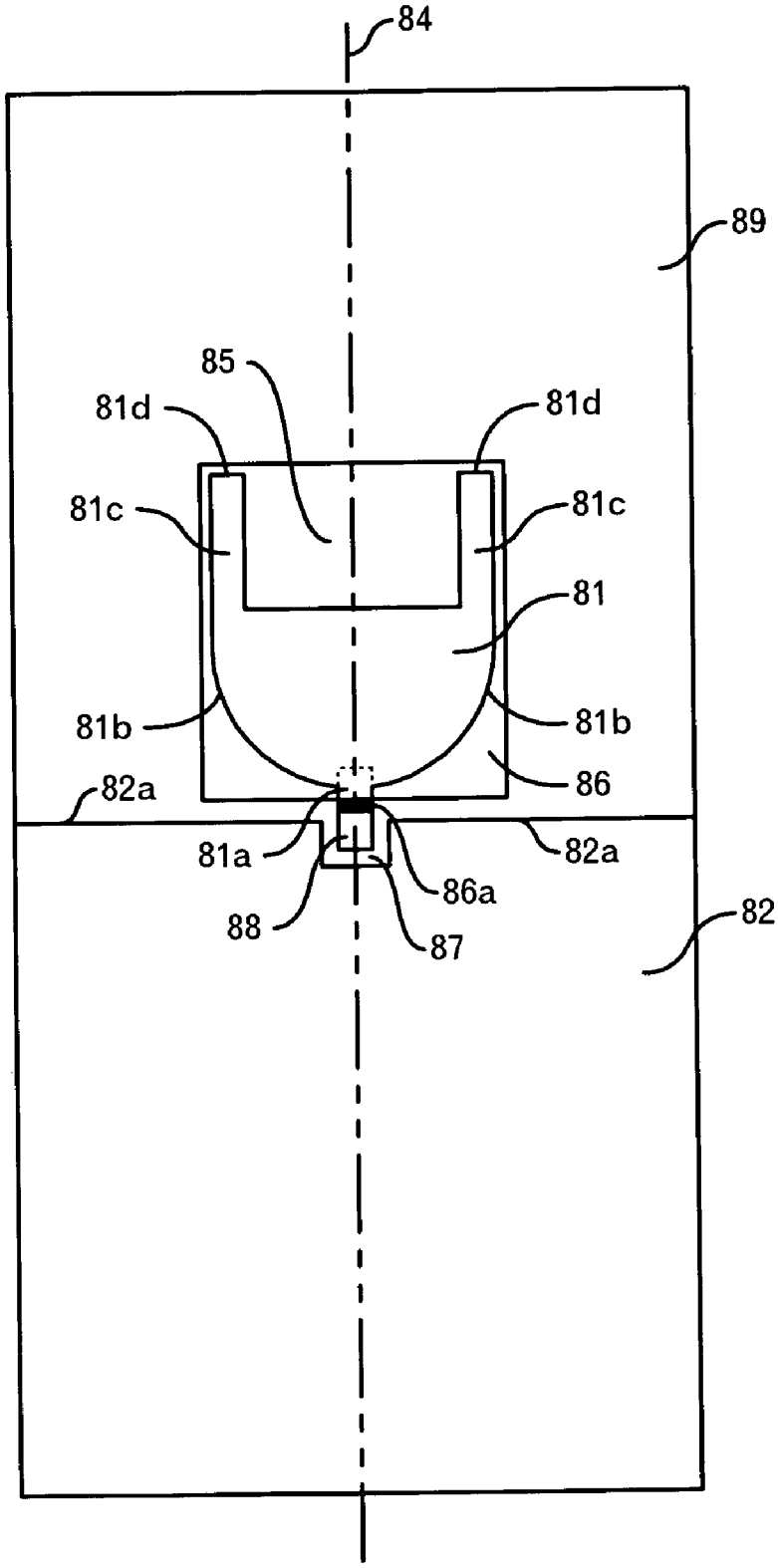
FIG. 14 is a diagram showing the structure of an antenna according to a ninth embodiment.

FIG. 14 shows the structure of an antenna according to a ninth embodiment of the present invention. In this embodiment, an example will be explained where a planar element 81 having an arc edge portion opposite to the edge of a ground pattern 82 is formed in a dielectric substrate 86 having a dielectric constant of about 20. The antenna according to the ninth embodiment comprises a dielectric substrate 86 that contains a conductive planar element 81 and equipped with an external electrode 86*a* at the outside thereof, a feed portion 88 that is connected to a high-frequency power source (not shown) to supply power to the planar element 81 and connected to the external electrode 86*a* of the dielectric substrate 86, and a ground pattern 82 that has a recess 87 for accommodating the feed portion 88 therein and is formed in or on a board 89 such as a printed circuit board or the like. The external electrode 86*a* is connected to a projecting portion 81*a* of the planar element 81, and extends to the back surface (i.e. dotted line portion of the back surface) of the dielectric substrate 86. The feed portion 88 contacts with the external electrode 86*a* provided on the edge portion of the side surface of the dielectric substrate 86 and the back surface, and the feed portion 88 and the external electrode 86*a* are overlapped with the dotted line portion.

The planar element 81 is equipped with the projecting portion 81*a* connected to the external electrode 86*a*, a curved line portion 81*b* opposite to a side 82*a* of the ground pattern 82, arm portions 81*c* for securing current paths for low frequencies, and a rectangular cut-out portion 85 formed so as to concave from the top portion 81*d* toward the ground pattern 82. The dielectric substrate 86 containing the planar element 81 is juxtaposed with the ground pattern 82.

Incidentally, in this embodiment, the planar element 81 is formed inside the dielectric substrate 86. That is, the dielectric substrate 86 is formed by laminating ceramic sheets, and the conductive planar element 81 is formed as one layer of the laminate. Accordingly, when viewed from the upper side, the planar element 81 is not actually viewed like FIG. 14. If the planar element 81 is formed inside the dielectric substrate 86, the effect of the dielectric material is slightly stronger as compared with the case where it is exposed, so that the miniaturization can be more enhanced and reliability and/or resistance to such as rust or the like can be enhanced. However, the planar element 81 may be formed on the surface of the dielectric substrate 86.

The ground pattern 82 is provided with the recess 87 for accommodating the feed portion 88. Therefore, the sides 82*a* opposite to the curved portion of the planar element 81 are not straight, but divided into two segments. The antenna according to this embodiment is symmetrical with respect to a line 84 passing through the center of the feed portion 88. The rectangular cut-out portion 85 is also symmetrical with respect to the line 84. The distance between the curved lines 81*b* of the planar element 81 and the sides 82*a* of the ground pattern 82 is gradually increased as being farther away from the line 84 along with the curved line 81*b*, and it is symmetric with respect to the line 84. The structure of the side surface is almost the same as FIG. 11B except for the portions corresponding to the feed portion 88 and the external electrode 86*a*. That is, the plane of the dielectric substrate 86 including the planar element 81 is disposed to be parallel or substantially parallel to the plane of the ground pattern 82.

Also in this embodiment, the ground pattern 82 is formed without surrounding the dielectric substrate 86 including the planar element 81 and the antenna is separated into the ground pattern 82 side and the dielectric substrate 86 side up and down.

Figure 15:
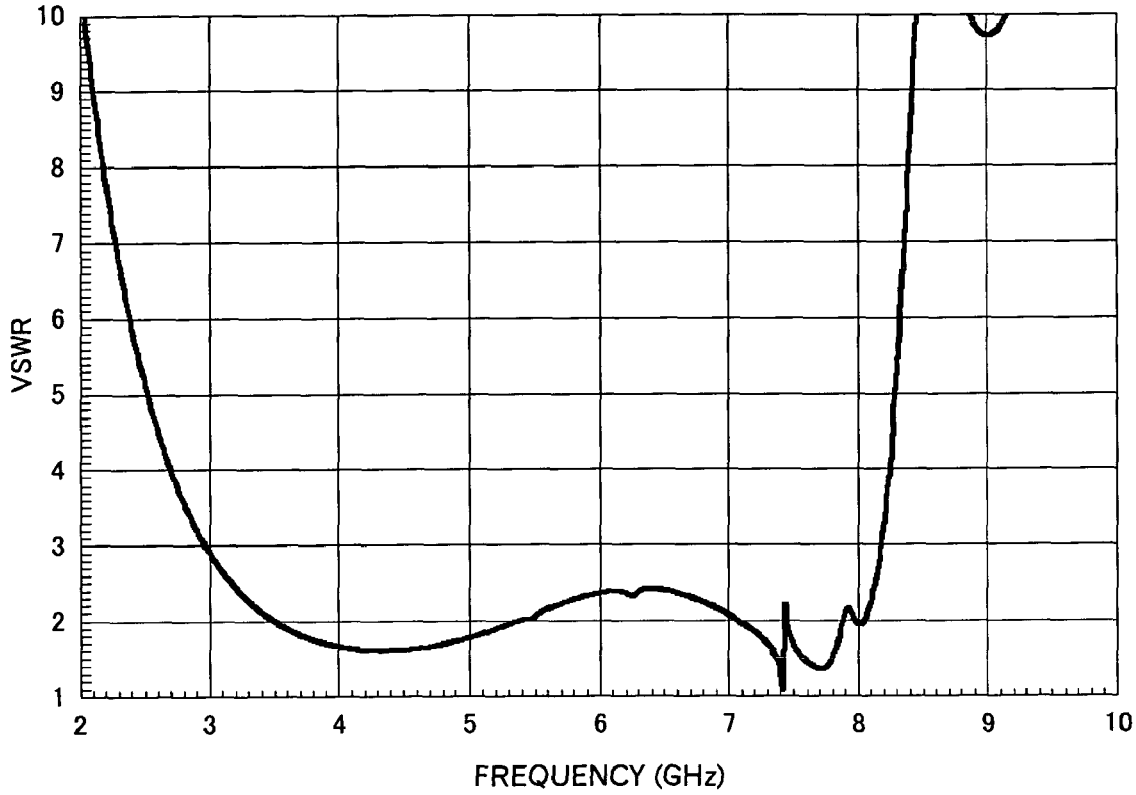
FIG. 15 is a diagram showing the characteristic of an antenna according to the ninth embodiment.
Figures 1, 16A:
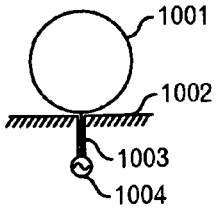
Figures 2, 16A:
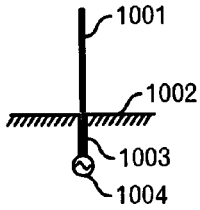
Figures 1, 16B:
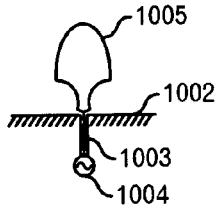
Figures 2, 16B:
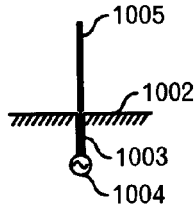
Figure 16C:
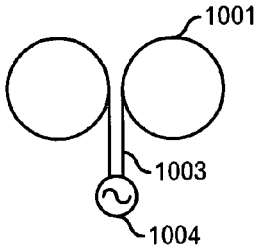
Figure 16D:
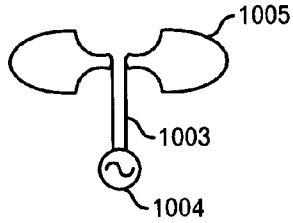
Figure 16E:
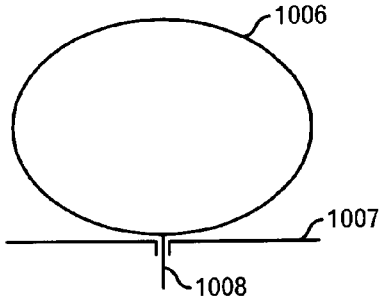
Figure 16F:
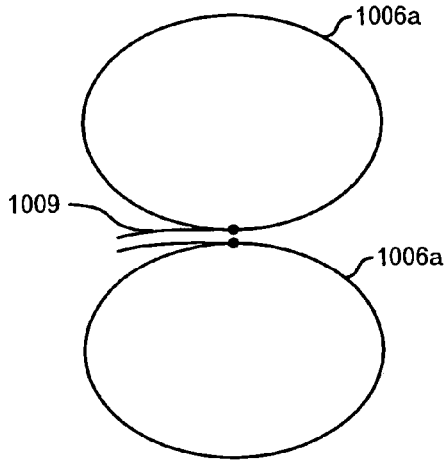
Figure 16G:
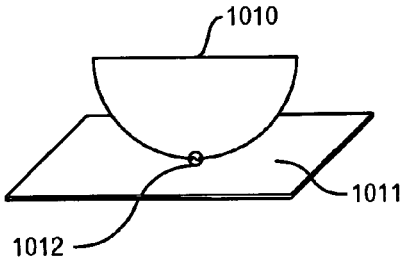
Figure 16H:
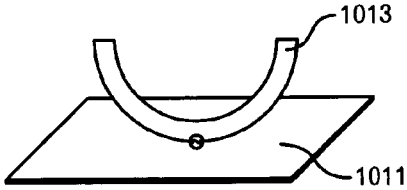
Figure 16I:
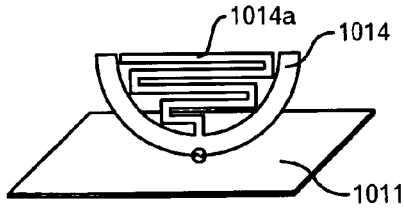
FIG.16I PRIOR ART
Figure 17:
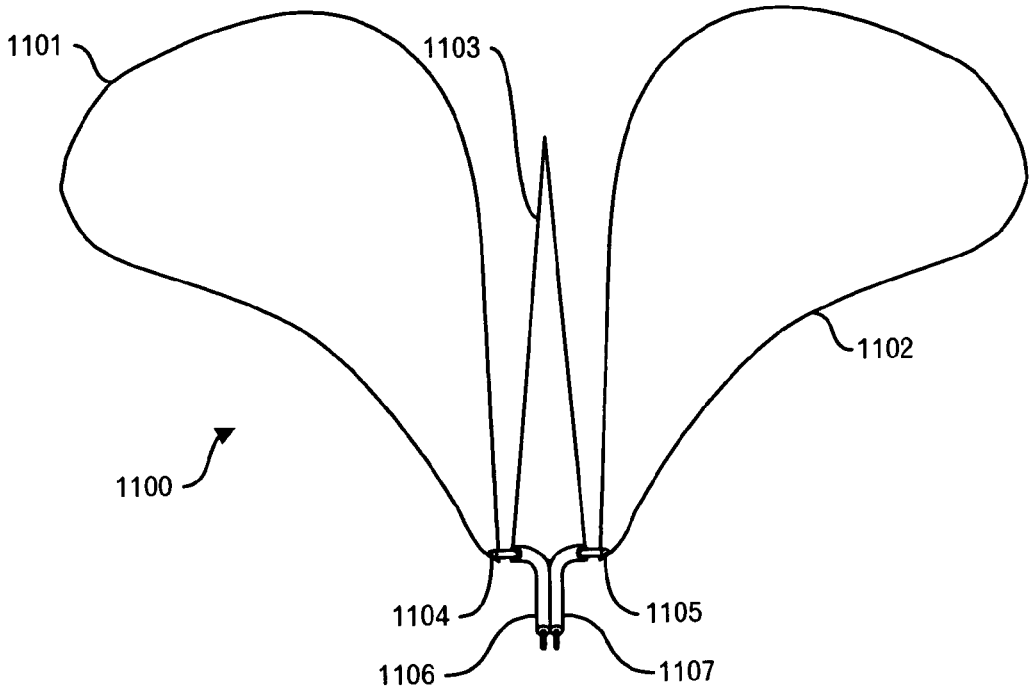
FIG.17 PRIOR ART
FIG. 17 is a diagram showing the structure of a conventional antenna.
Figure 18:
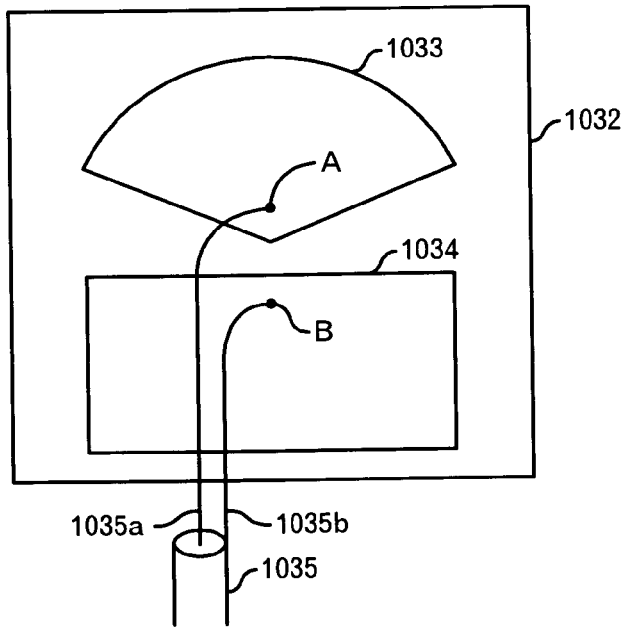
FIG.18 PRIOR ART
FIG. 18 is a diagram showing the structure of a conventional antenna.
Figure 19:
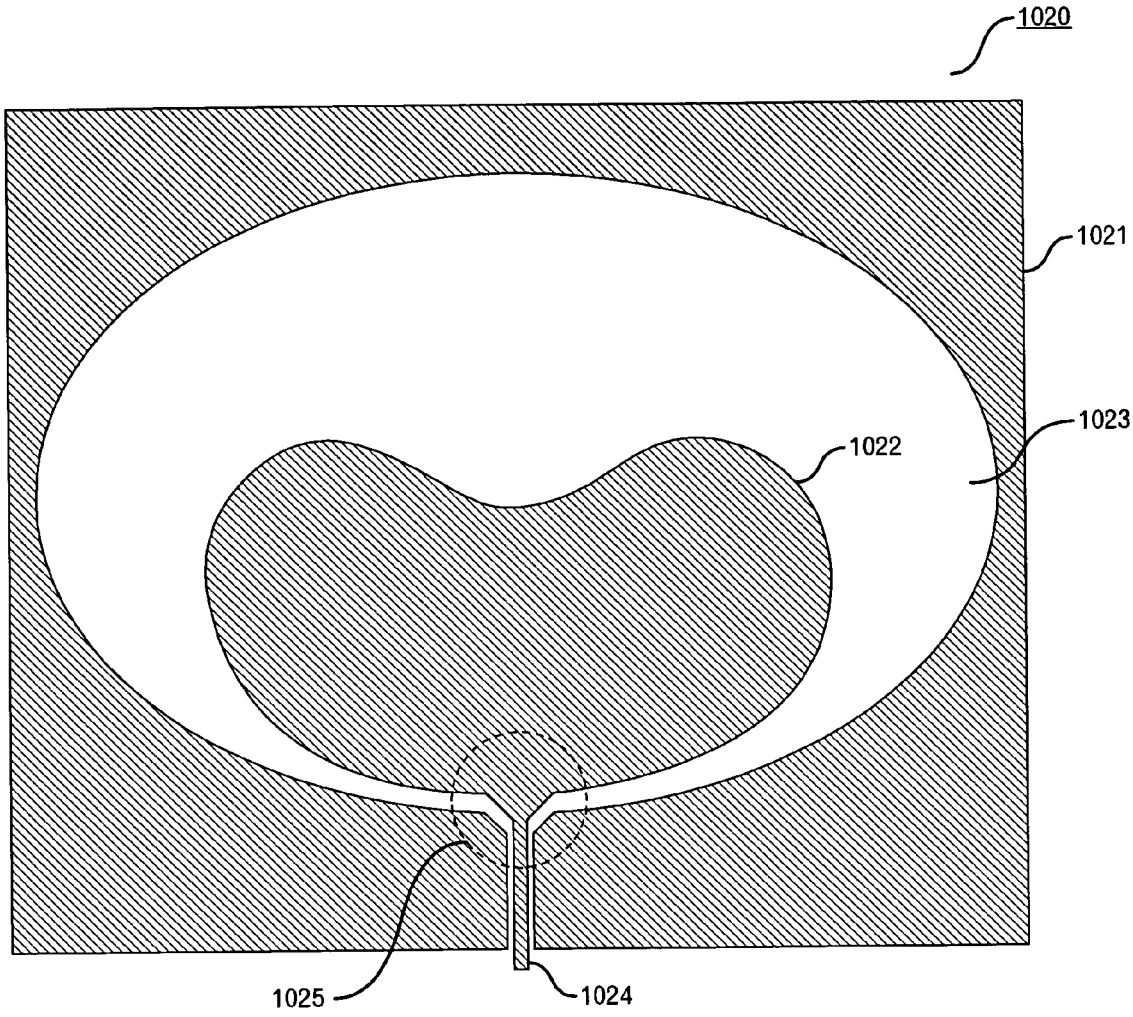
FIG.19 PRIOR ART
FIG. 19 is a diagram showing the structure of a conventional antenna.

FIG. 15 shows the impedance characteristic of the antenna according to this embodiment. In FIG. 15, the axis of ordinate represents VSWR and the axis of abscissa represents the frequency (GHz). The frequency range in which VSWR is not more than 2.5 extends from about 3.2 GHz to about 8.2 GHz.

Though the embodiments of the present invention were explained, this invention is not limited to these embodiments. For example, though the shape of the cut-out portion of the planar element is indicated to be a rectangle as a typical example, it may be designed in a trapezoidal shape or other polygonal shape. The corners of the cut-out portion may be rounded. As for the tapered shape of the ground pattern, it may be composed of lines other than the segments. Moreover, though an example in which a recess for accommodating an electrode for feeding is provided was explained, it is unnecessary to form an acute angle to the tip of the ground pattern.

In addition, though an example in which the edge portion of the planar element is composed of downwardly convex arcs was mainly explained, it may be composed of downwardly convex line segments which are connected while their inclinations are changed stepwise.

Although the present invention has been described with respect to a specific preferred embodiment thereof, various change and modifications may be suggested to one skilled in the art, and it is intended that the present invention encompass such changes and modifications as fall within the scope of the appended claims.

What is claimed is:

1. An antenna, comprising:

a ground pattern; and a planar element, which has a feed point, wherein said planar element has a trimmed portion causing to continuously change a distance between said planar element and said ground pattern, and a rectangular cut-out portion formed at an edge portion opposite to the ground pattern side of said planar element, and said trimmed portion is composed of an arc, an edge of said ground pattern, which is adjacent to said planar pattern, is straight, and said ground pattern and said planar element are formed in or on a board without overlapping each other.

2. The antenna as set froth in claim 1, wherein said trimmed portion is formed from said feed point toward a side opposite to said ground pattern.

3. The antenna as set forth in claim 1, wherein said planar element and said ground pattern are formed extending along counter directions respectively.

4. The antenna as set forth in claim 1, wherein said ground pattern is disposed without surrounding said planar element.

5. The antenna as set forth in claim 1, wherein said distance from said trimmed portion of said planar element to said ground pattern is gradually increased as being farther away from said feed point of said planar element.

6. The antenna as set forth in claim 1, wherein at least a part of the edge portion other than said trimmed portion is formed so as to be opposite to the ground pattern side of said planar element.

7. The antenna as set forth in claim 1, wherein said planar element is symmetric with respect to a straight line passing through said feed point of said planar element.

* * * * *